US010863292B2

(12) United States Patent
Flaig et al.

(10) Patent No.: US 10,863,292 B2
(45) Date of Patent: Dec. 8, 2020

(54) ELASTIC DAMPING ELEMENT FOR HEARING INSTRUMENT RECEIVER AND HEARING INSTRUMENT WITH SUCH A DAMPING ELEMENT

(71) Applicant: SIVANTOS PTE. LTD., Singapore (SG)

(72) Inventors: Uwe Flaig, Feucht (DE); Hartmut Ritter, Neunkirchen am Brand (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/528,725

(22) Filed: Aug. 1, 2019

(65) Prior Publication Data

US 2020/0068325 A1 Feb. 27, 2020

(30) Foreign Application Priority Data

Aug. 24, 2018 (DE) ..... 10 2018 214 321

(51) Int. Cl.
*H04R 25/00* (2006.01)

(52) U.S. Cl.
CPC ..... *H04R 25/70* (2013.01); *H04R 25/604* (2013.01); *H04R 25/65* (2013.01)

(58) Field of Classification Search
CPC ..... H04R 25/65; H04R 25/70; H04R 25/456; H04R 25/604
See application file for complete search history.

(56) References Cited

U.S. PATENT DOCUMENTS

| | | | | |
|---|---|---|---|---|
| 9,578,429 | B2 * | 2/2017 | Karamuk | H04R 25/604 |
| 2008/0112584 | A1 | 5/2008 | Karamuk | |
| 2014/0333012 | A1 * | 11/2014 | Riepenhoff | H04R 25/658 264/401 |
| 2018/0176678 | A1 * | 6/2018 | Bolsman | H04R 25/456 |

FOREIGN PATENT DOCUMENTS

| | | | |
|---|---|---|---|
| EP | 2087769 | A2 | 8/2009 |
| EP | 2753102 | A1 | 7/2014 |
| EP | 3337191 | A1 | 6/2018 |
| WO | 2007038897 | A2 | 4/2007 |
| WO | 2013107500 | A1 | 7/2013 |

* cited by examiner

*Primary Examiner* — Brian Ensey
(74) *Attorney, Agent, or Firm* — Laurence A. Greenberg; Werner H. Stemer; Ralph E. Locher

(57) ABSTRACT

An elastic damping element provides a vibration-damping mounting of a receiver inside a hearing instrument. The damping element contains a hollow base body, from the inner surface of which a plurality of retaining projections project, and each retaining projection has at its distal end a contact surface for the receiver that will be mounted there. A recess, which is formed in an outer surface of the base body in alignment with the associated retaining projection in order to achieve a reduced material thickness, corresponds with at least one of the retaining projections.

7 Claims, 6 Drawing Sheets

ELASTIC DAMPING ELEMENT FOR HEARING INSTRUMENT RECEIVER AND HEARING INSTRUMENT WITH SUCH A DAMPING ELEMENT

CROSS-REFERENCE TO RELATED APPLICATION

This application claims the priority, under 35 U.S.C. § 119, of German application DE 10 2018 214 321.8, filed Aug. 24, 2018; the prior application is herewith incorporated by reference in its entirety.

BACKGROUND OF THE INVENTION

Field of the Invention

The invention relates to an elastic damping element for the vibration-damping mounting of a receiver inside a hearing instrument. The invention also relates to a hearing instrument with such an elastic damping element.

A "hearing instrument" is generally defined as a device that receives ambient sound, modifies it through signal-processing technology, and emits a modified sound signal to the hearing system of a person wearing the hearing instrument.

A hearing instrument that is configured for the care of a hearing-impaired person and processes ambient acoustic signals, in particular amplifies these signals in such a way that the hearing damage is fully or partially compensated, is referred to here and hereinafter as a "hearing aid". A hearing aid usually includes an input transducer, for example in the form of a microphone, a signal processing unit with an amplifier, and an output transducer. The output transducer is usually implemented as a miniature loudspeaker and is also referred to as a "receiver."

In addition to hearing aids, however, there are also hearing instruments that are configured to provide care for normal hearing people, to protect the respective wearer's hearing system or to support noise perception for specific purposes (for example the understanding of speech in complex noise environments). Such hearing instruments are often similar in design to hearing aids and in particular comprise the aforementioned components: input transducer, signal processing unit and output transducer.

In order to meet the numerous individual requirements, different types of hearing instruments are available. With behind-the-ear (BTE) hearing instruments, a housing equipped with the input transducer, signal processing unit and a battery is worn behind the ear. Depending on the configuration, the receiver may be arranged directly in the wearer's ear canal (so-called ex-receiver hearing instruments or receiver-in-channel (RIC) hearing instruments). Alternatively, the receiver is arranged inside the housing. In this case, a flexible sound tube, also referred to as a "tube", directs the acoustic output signals of the receiver from the housing to the ear canal (tube hearing instruments). In the case of in-the-ear (ITE) hearing instruments, a housing containing all functional components including the microphone and the receiver is worn at least partially in the ear canal. Completely-in-canal (CIC) hearing instruments are similar to ITE hearing instruments, but are worn entirely in the ear canal.

Independently of the design, it is necessary, to mount the receiver inside the hearing instrument housing in a safe and in particular vibration-damped manner, particularly in order to minimize or avoid acoustic feedback.

In order to achieve effective vibration damping, the receiver of a hearing instrument is usually mounted with individually shaped bearings adapted to both the respective receiver's construction and the available space in the hearing instrument as well as the hearing instrument's required amplification. It is common to damp a receiver by means of a rubber band or a rubber pocket wrapped around the rear part of the receiver, thus preventing bumping against the hard wall of the hearing instrument housing. In addition, receivers are often enclosed in plastic or metal chambers to prevent as much as possible airborne sound from being transmitted inside the housing of the respective hearing instrument.

The receiver is usually mechanically mounted by means of a sound tube made of rubber or an elastomer, which grips the sound outlet of the receiver and directs the sound the receiver generates to the outlet of the hearing instrument housing. However, using the sound tube as the receiver's principal mechanical mounting is disadvantageous in that the various functions of the sound tube, namely the mechanical support function, the damping function and the sound conduction function, would require contradictory formations of the sound tube and are therefore difficult to reconcile with one another. For example, in terms of effective vibration damping, a comparatively soft design of the sound tube would be advantageous, but it would be disadvantageous for the low-vibration mechanical mounting of the receiver and for sound conduction.

SUMMARY OF THE INVENTION

Accordingly, the object of the invention is to enable mounting a receiver inside a hearing instrument in a manner that is safe and effective in terms of vibration damping.

With regard to an elastic damping element, this object is accomplished according to the invention by the features of the independent elastic damping element claim. With regard to a hearing instrument, this object is accomplished according to the invention by the features of the independent hearing instrument claim. Advantageous configurations of the invention are set forth in the dependent claims and in the following description.

The elastic damping element is used for the vibration-damping mounting of a receiver inside a hearing instrument. The element contains a hollow (particularly but not necessarily elastic) base body from the inner surface of which a plurality of elastic retaining projections protrude. At a distal end (i.e. facing away from the inner surface of the base body), each of these retaining projections has a contact surface for the receiver that will be mounted there. According to the invention, at least one of the retaining projections corresponds to a recess formed on the outer surface of the base body in alignment with the retaining projection, so that the damping element has a reduced material thickness in the region of the corresponding retaining projection (compared to a corresponding body that has a smooth outer wall). Because of the recess, the corresponding retaining projection forms a hollow shape open to the outside.

The recess and the specific design thereof make it possible to adapt the damping characteristics of each retaining projection individually to the receiver's vibration behavior, independently of the material of the damping element and with great flexibility and precision, in order to both maintain stability and to damp particularly effectively in a manner adapted to the direction and intensity of movement of the respective receiver type.

In particular, the or each recess creates a hollow volume into which the material of the retaining projection may escape when the receiver compresses it. A sound tube that couples the sound output of the receiver with the outside of the hearing instrument housing is largely relieved of mechanical load by the damping element according to the invention, and may therefore its sound transmission and damping properties may be better optimized than would be the case for a conventional sound tube that also has a load-bearing function. The at least one recess opened to the outside also allows the damping element to be manufactured more easily—compared to damping elements having closed air cushions—for example by injection-molding.

Preferably, each of the retaining projections is formed as a conically shaped knob. The conical knobs hold the receiver suspended in the damping element. In this way, the friction losses caused by damping are kept low, and this in turn makes it possible to achieve high acoustic power at the receiver's sound output.

In an expedient embodiment, the elastic base body is designed as a tube that completely encloses the receiver—and preferably has a cross-section adapted to the receiver (for example a rectangular cross-section). In other words, the base body is open on two opposite sides. The receiver is preferably inserted into the tubular damping element in such a way that its sound outlet and the opposite rear side of the receiver are arranged on the open sides of the damping element. Consequently, the receiver's movement along its main direction of vibration, which is usually parallel to the sound outlet, is only slightly restricted.

In a preferred embodiment of the invention, different retaining projections of the damping element are filled to different degrees. The damping element in this embodiment thus contains at least two retaining projections, each of which is respectively completely or partially hollowed out by a corresponding recess, these recesses having different depths. This in turn makes it possible to adapt each retaining projection to the receiver's vibration behavior in a particularly flexible and individualized manner. In addition to hollow and/or partially filled retaining projections, the damping element may also comprise one or more completely filled retaining projections, i.e. retaining projections that do not have an associated recess; thus, in the area of these projections, the outer wall of the damping element is smooth.

The base body and retaining projections are preferably made of an elastomeric material, and particularly preferably of a fluoroelastomer and/or a fluorosilicone elastomer. For example, the base body and/or retaining projections are made of a fluoroelastomer that DuPont sells under the trade name "Viton."

In a suitable embodiment of the invention, the base body and retaining projections are prepared from the same material, in particular in one piece (monolithic). In an advantageous alternative embodiment, in contrast, the retaining projections are prepared from a softer material than the base body. In this case, the base body and retaining projections are produced in a two-component injection-molding process, which is expedient (but not mandatory). A metal/elastomer or plastic/elastomer combination may also be considered without departing from the scope of the invention.

Within the scope of the invention, the retaining projections may be placed on a continuous (uninterrupted) wall of the base body. In one advantageous alternative embodiment, in contrast, the base body is furnished with an opening (i.e. an opening that extends from the inside to the outside of the base body) in the region of at least one retaining projection, and the retaining projection is inserted, and in particular injected, into this opening. This embodiment makes it possible for the retaining projection to drop through the wall of the base body when subjected to the load of the receiver; the external recess near the retaining projection also in particular promotes this. The movability of the retaining projection(s) makes it possible to design the base body to be comparatively hard and thus stable, while maintaining a high elastic flexibility of the damping element.

The hearing instrument according to the invention contains a housing, a receiver and the elastic damping element according to the invention, according to one of the above-described configurations. The receiver is mounted inside the hearing instrument housing in a vibration-damping manner, by the elastic damping element. For this purpose, the elastic damping element surrounds the receiver, in particular on the outer circumference thereof.

The advantages of the individual embodiments described for the damping element according to the invention may be transferred analogously to corresponding embodiments of the hearing instrument according to the invention.

The damping element according to the invention may be used advantageously in hearing instruments of the above-described types, i.e. in both BTE and ITE devices.

Other features which are considered as characteristic for the invention are set forth in the appended claims.

Although the invention is illustrated and described herein as embodied in an elastic damping element for a hearing instrument receiver and a hearing instrument with such a damping element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Components that correspond to each other are always assigned the same reference signs in all drawings.

Figure 1:
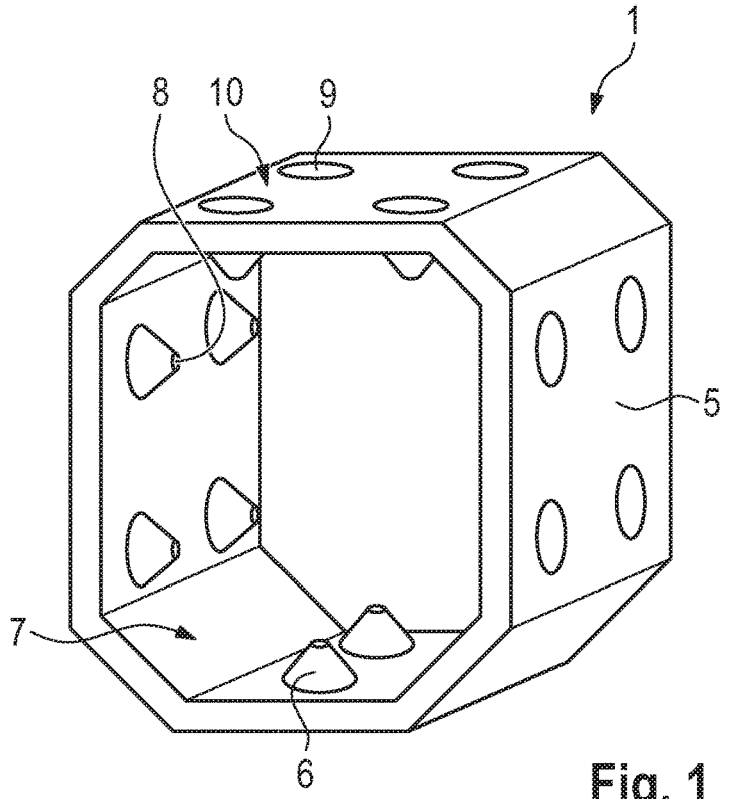
FIG. 1 is a diagrammatic, perspective view of a first embodiment of an elastic damping element for the vibration-damping mounting of a receiver of a hearing instrument.
Figure 2:
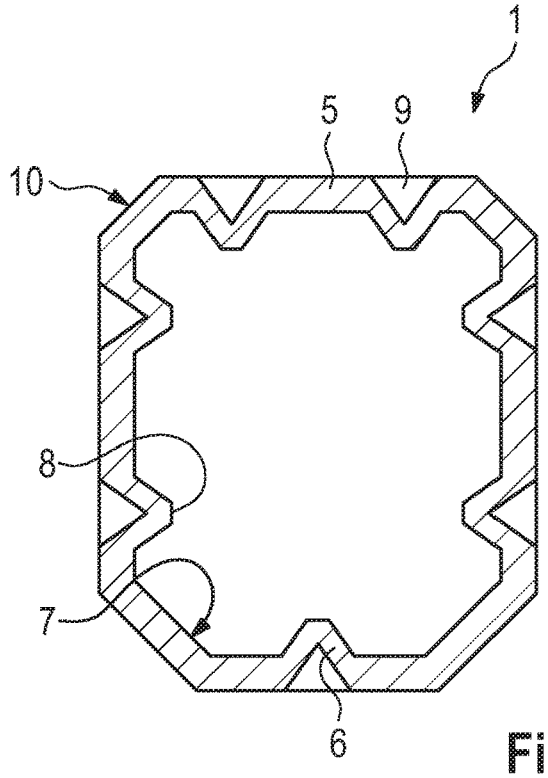
FIG. 2 is a cross-sectional view of the elastic damping element with the receiver as shown in FIG. 1.

Referring now to the figures of the drawings in detail and first, particularly to FIGS. 1 and 2 thereof, there is shown an elastic damping element 1 that is used for mounting a receiver 2 (FIG. 3) in a vibration-damping manner, inside a hearing instrument 3 (FIG. 12) that is configured as a hearing aid.

The elastic damping element 1 contains an elastic tubular base body 5 made of a fluorosilicone elastomer (in particular "Viton") with an approximately square cross-section. The damping element 1 also contains a plurality of retaining projections 6 in the form of conical knobs that protrude from an inner surface 7 of the base body 5 into the interior that the base body encloses. Each of the retaining projections 6 has a contact surface 8 at its distal end (i.e. facing away from the inner surface 7), for the receiver 2 that will be mounted there.

In the exemplary embodiment shown in FIGS. 1 and 2, each retaining projection 6 corresponds to a recess 9 that is formed in an outer surface 10 of the base body 5 in alignment with the respective retaining projection 6. As a result of the corresponding recesses 9, the retaining projections 6 thus each respectively form a hollow shape that is open toward the outer surface 10 (approximately in the manner of a perforated dent).

Figure 3:
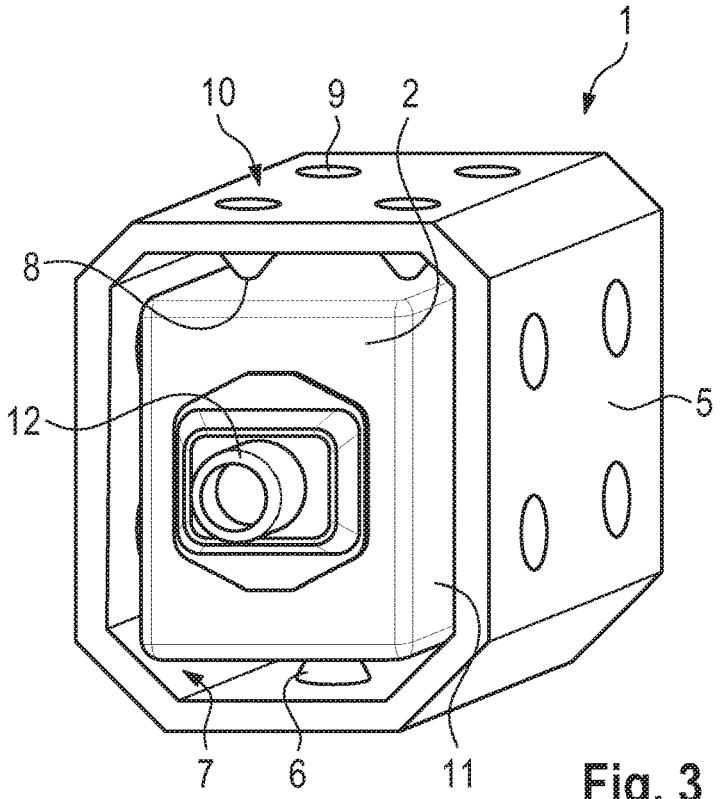
FIG. 3 is a perspective view as shown in FIG. 1 of the elastic damping element with the receiver mounted therein.
Figure 4:
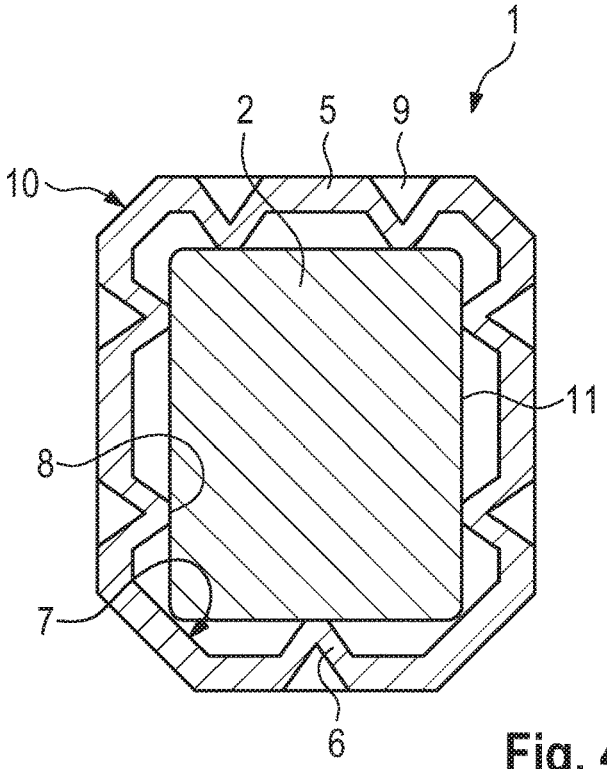
FIG. 4 is a cross-sectional view as shown in FIG. 2 of the elastic damping element with the receiver mounted therein.

As shown in FIGS. 3 and 4, the receiver 2 is properly inserted into the interior of the damping element 1 so that its outer circumference 11 contacts the contact surfaces 8 of the retaining projections 6. The tubular base body 5 of the damping element 1 completely encloses the side surfaces of the receiver 2. A connection 12 of the receiver 2 for a sound tube, and a rear side of the receiver 2 opposite this connection 12, are arranged on the open sides of the tubular base body 5.

Figure 5:
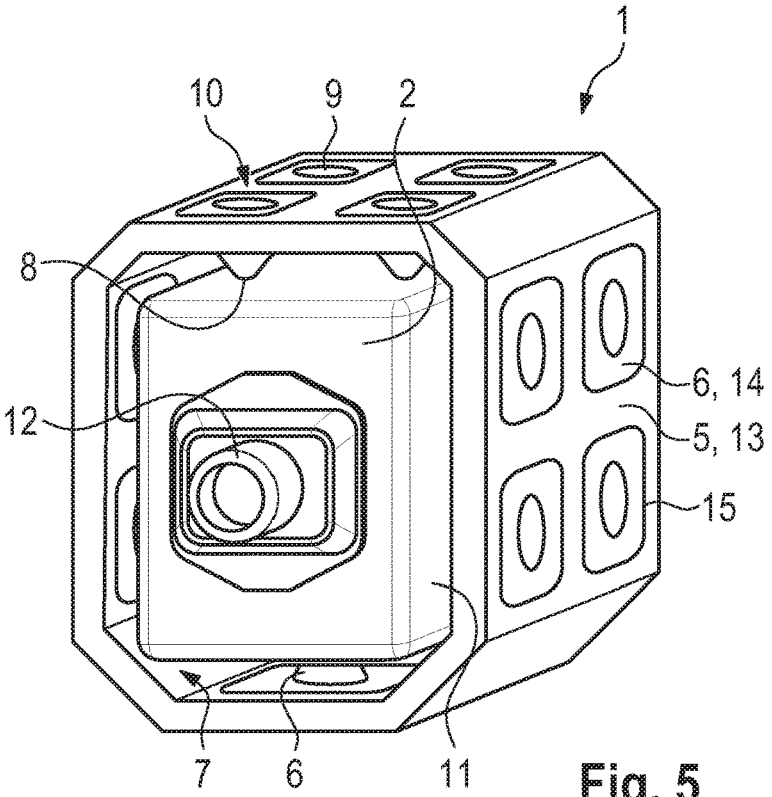
FIG. 5 is a perspective view as shown in FIG. 1 of a second embodiment of the elastic damping element with the receiver mounted therein.
Figure 6:
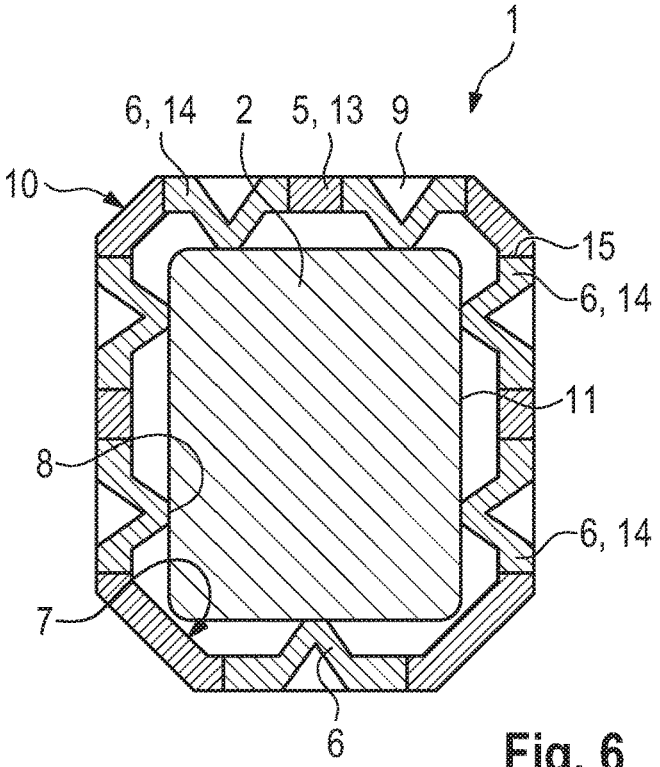
FIG. 6 is a cross-sectional view as shown in FIG. 2 of the second embodiment of the elastic damping element with the receiver mounted therein.

FIGS. 5 and 6 show a second embodiment of the elastic damping element 1. This differs from the damping element 1 made from a single material in one piece as shown in FIGS. 1 to 4, in that the base body 5 and retaining projections 6 are prepared from different materials 13 and 14. The material 13 used for the base body 5 is harder than the material 14 from which the retaining projections 6 are prepared. In a preferred embodiment, the material 13 and material 14 are fluorosilicone elastomers (in particular "Viton") with different hardnesses.

In the embodiment shown in FIGS. 5 and 6, the base body 5 that consists of the comparatively hard material 13 is furnished with openings 15, and a retaining projection 6 of the comparatively soft material 14 is respectively injected into each opening 15, including the associated recess 9. The damping element 1 shown in FIGS. 5 and 6 is in particular prepared in a two-component injection-molding process.

Figure 7:
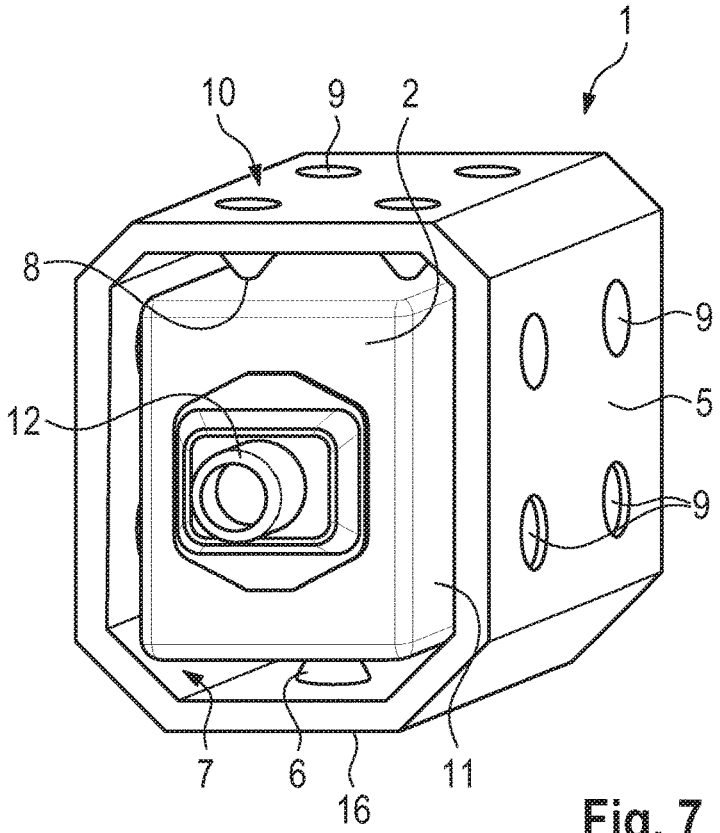
FIG. 7 is a perspective view as shown in FIG. 1 of a third embodiment of the elastic damping element with the receiver mounted therein.
Figure 8:
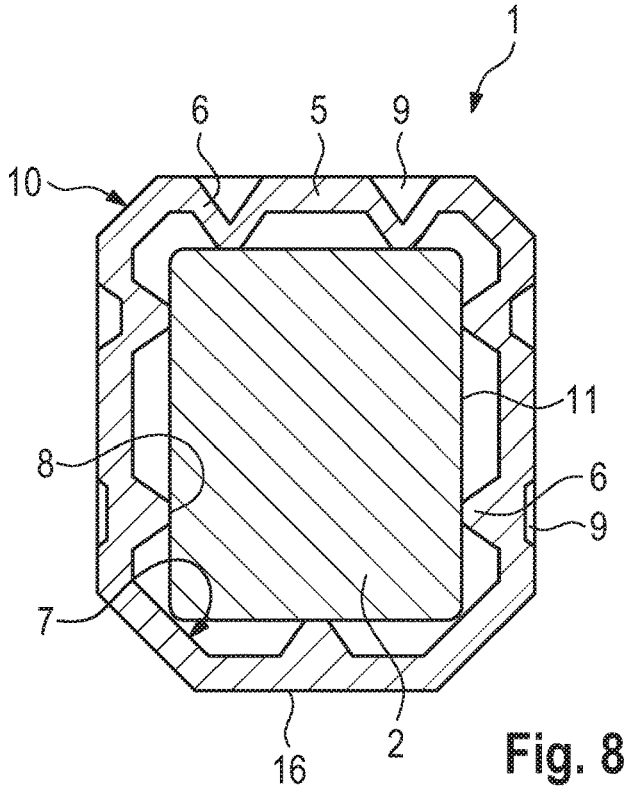
FIG. 8 is a cross-sectional view as shown in FIG. 2 of the third embodiment of the elastic damping element with the receiver mounted therein.

FIGS. 7 and 8 show a third variant of the elastic damping element 1, which is manufactured in one piece from a single material as in the embodiment shown in FIGS. 1 to 4. However, the embodiment shown in FIGS. 7 and 8 differs from the damping element 1 shown in FIGS. 1 to 4 in that the recesses 9 have different depths. Correspondingly, the corresponding retaining projections 6 are filled to a different extent and thus have different elasticities.

In the example shown, the degree of filling of the retaining projections increases towards the bottom, so that the receiver 2 is mounted more softly in the upper region of the damping element 1 than in the lower region. In this case, the retaining projections 6 that are arranged on a bottom 16 of the base body 5 are completely filled. These retaining projections 6 that are arranged on the bottom 16, are therefore not associated with a corresponding recess on the outer surface 8 of the base body 5. Instead, the outer surface 8 is flat in the area of the bottom 16. The terms "bottom" and "above" and "below" refer only to the orientation of the damping element 1, in the drawing and do not describe the orientation of the damping element 1 in the surrounding space when the damping element 1 has been installed in a hearing aid 3.

The degree of filling of the individual retaining projections 6 is selected to match the vibration behavior of the receiver 2 in such a way that a particularly effective acoustic damping of the receiver 2 is achieved, thus particularly effectively suppressing transmission of vibrations from the receiver 2 to other components of the hearing aid 3 that contains the receiver 2 and damping element 1.

Figure 9:
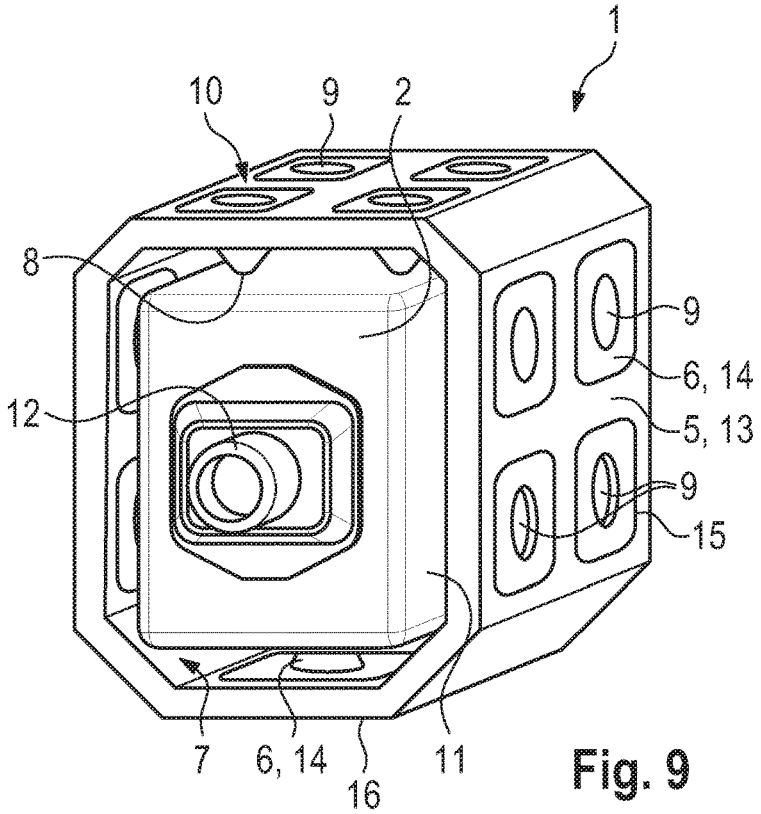
FIG. 9 is a perspective view as shown in FIG. 1 of a fourth embodiment of the elastic damping element with the receiver mounted therein.
Figure 10:
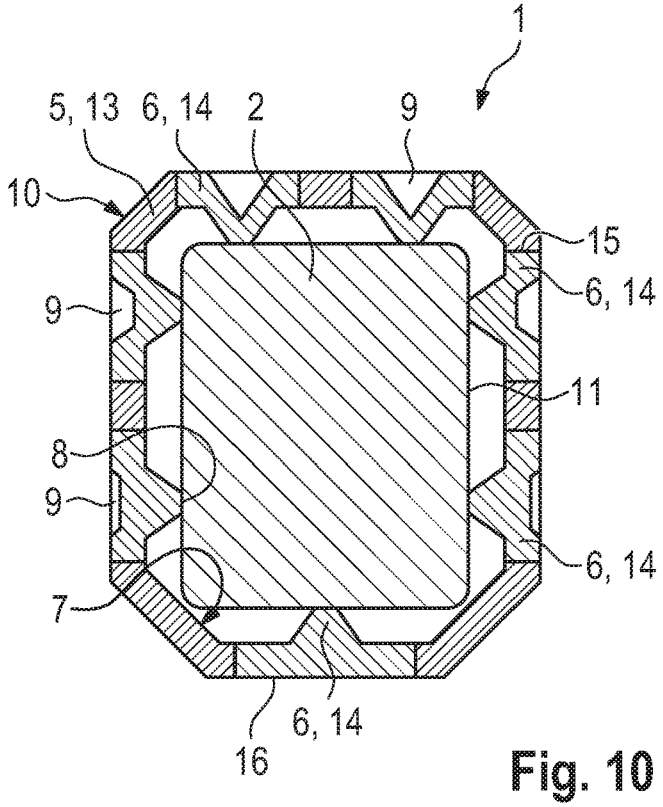
FIG. 10 is a cross-sectional view as shown in FIG. 2 of a fourth embodiment of the elastic damping element with the receiver mounted therein.

FIGS. 9 and 10 show a fourth variant of the elastic damping element 1, in which the design features of the damping elements 1 shown in FIGS. 5 to 8 are combined. Specifically, the damping element 1 shown in FIGS. 9 and 10 has the two-component structure of the damping element 1 shown in FIGS. 5 and 6, made up of different hard materials 13 and 14, in combination with the varying degree of filling of the retaining projections 6 of the damping element shown in FIGS. 7 and 8.

Figure 11:
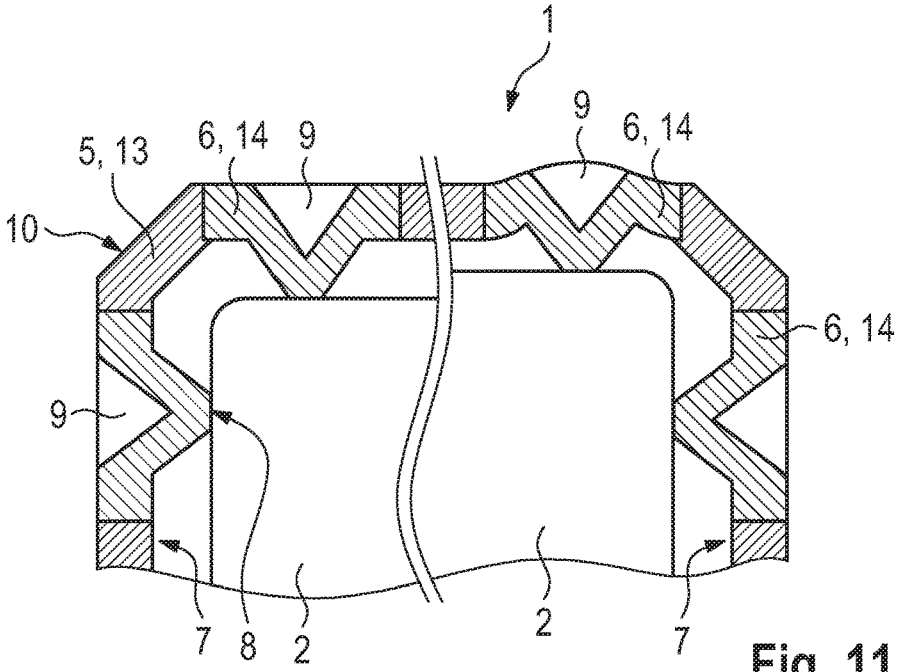
FIG. 11 is a section view, analogous to FIG. 6, of the damping element therein in a rest state and a state loaded by the receiver.

FIG. 11 shows, by means of two distinguished partial views analogous to FIG. 5, how the retaining projections 6 of the damping element 1 (here, for example, in the embodiment shown in FIGS. 5 and 6) deform from their rest position (left half of the drawing) when subjected to a load from the vibrating receiver 2 (right half of the drawing; strongly exaggerated here for purposes of illustration). The illustration here shows in particular that the retaining projections 6 may expand under load over the outer surface 10 of the base body 5, even the base body 5 remains largely stable in shape.

Figure 12:
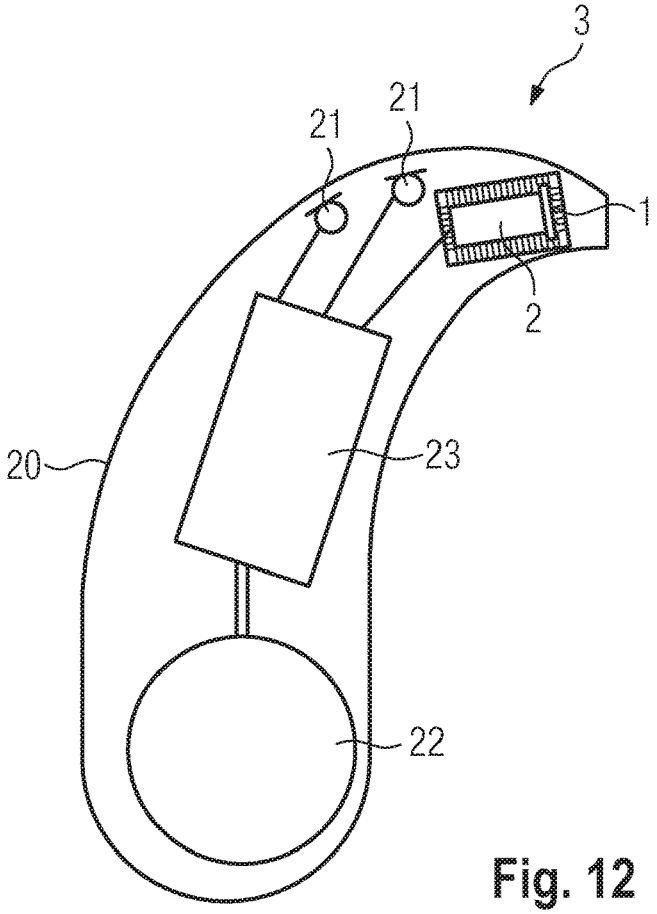
FIG. 12 is a schematic view of a hearing instrument with the receiver mounted by the elastic damping element.

FIG. 12 shows a hearing aid 3 with a housing 20 in which the receiver 2 mounted inside the damping element 1 is installed. The hearing aid 3 also has two microphones 21, a battery 22 and a signal processing unit 23.

As a result of the retaining projections 6 of the damping element 1, the receiver 2 is mounted so that it may move comparatively freely in its main direction of vibration—parallel to the axis of the base body 5.

The invention is particularly clear in the exemplary embodiments described above, but is not limited to these exemplary embodiments. Rather, additional embodiments of the invention may be derived from the claims and the above description.

The following is a summary list of reference numerals and the corresponding structure used in the above description of the invention:

1 Damping element
2 Receiver
3 Hearing instrument
5 Base body
6 Retaining projection
7 Inner surface (of the base body)
8 Contact surface
9 Recess
10 Outer surface (of the base body)
11 Outer circumference (of the receiver)
12 Connection
13 Material
14 Material
15 Opening
16 Bottom
20 Housing
21 Microphone
22 Battery
23 Signal processing unit

The invention claimed is:

1. An elastic damping element for a vibration-damping mounting of a receiver inside a hearing instrument, the elastic damping element comprising:

a hollow base body having an inner surface and a plurality of retaining projections projecting from said inner surface, each of said retaining projections having at a distal end a contact surface for the receiver that will be mounted, said hollow base body further having an outer body with at least one recess formed therein, wherein at least one of said retaining projections corresponding to said recess which, in order to achieve a reduced material thickness, is formed in said outer surface of said hollow base body in alignment with said at least one retaining projection;

said retaining projections being formed from a softer material than said hollow base body; and said hollow base body having an opening formed therein and at least one of said retaining projections is inserted into said opening in said hollow base body.

2. The elastic damping element according to claim 1, wherein said retaining projections are respectively formed in a shape of a conical knob.

3. The elastic damping element according to claim 1, wherein said hollow base body is in a form of a tube that encloses the receiver completely circumferentially.

4. The elastic damping element according to claim 1, wherein said recess is one of two recesses formed in said outer surface of said hollow base body and respectively correspond to two of said retaining projections, and wherein said recesses have different depths.

5. The elastic damping element according to claim 1, wherein said hollow base body and said retaining projections are formed as a two-component injection-molded part.

6. The elastic damping element according to claim 1, wherein said at least one retaining projection is injected into said opening in said hollow base body.

7. A hearing instrument, comprising:

a housing;

a receiver;

an elastic damping element containing a hollow base body having an inner surface and a plurality of retaining projections projecting from said inner surface, wherein each of said retaining projections having at a distal end a contact surface for assisting in mounting said receiver, said hollow base body further having an outer body with at least one recess formed therein, wherein at least one of said retaining projections corresponding to said recess which, in order to achieve a reduced material thickness, is formed in said outer surface of said hollow base body in alignment with said at least one retaining projection, wherein said retaining projections being formed from a softer material than said hollow base body, wherein said hollow base body having an opening formed therein and at least one of said retaining projections is inserted into said opening in said hollow base body; and said receiver mounted inside said housing in a vibration-damping manner by means of said elastic damping element.

* * * * *